United States Patent [19]

Hunziker

[11] 4,432,103

[45] Feb. 21, 1984

[54] STEAM BATH APPARATUS AND LIQUID OR STEAM TREATMENT EQUIPMENT

[76] Inventor: Walter Hunziker, Villastrasse 14, 6010 Kriens, Switzerland

[21] Appl. No.: 296,230

[22] Filed: Aug. 25, 1981

[30] Foreign Application Priority Data

Aug. 26, 1980 [EP] European Pat. Off. ..... 80810265.1

[51] Int. Cl.[3] ..... A61H 33/06

[52] U.S. Cl. ..... 4/525; 4/597

[58] Field of Search ..... 4/524, 525, 526, 528, 4/531, 533, 597, 598, 535; 128/367, 369, 371, 374

[56] References Cited

U.S. PATENT DOCUMENTS

| | | | |
|---|---|---|---|
| 239,106 | 3/1881 | McFarland et al. | 128/367 X |
| 257,875 | 5/1882 | Lawson | 128/367 |
| 1,096,620 | 5/1914 | Geiger | 4/524 X |
| 1,573,016 | 2/1926 | Pedroes | 4/528 |
| 2,021,145 | 11/1935 | Dyar | 4/597 |
| 2,567,506 | 9/1951 | Bowman | 4/598 |
| 2,640,201 | 6/1953 | Burwell | 4/525 |
| 2,902,580 | 9/1959 | Lowe et al. | 4/524 |
| 3,007,178 | 11/1961 | Altman et al. | 4/525 |
| 4,340,981 | 7/1982 | Vanags | 4/525 |

FOREIGN PATENT DOCUMENTS

| | | | |
|---|---|---|---|
| 423394 | 1/1947 | Italy | 4/598 |
| 1337250 | 11/1973 | United Kingdom | 4/524 |

*Primary Examiner*—Charles E. Phillips
*Attorney, Agent, or Firm*—Yount & Tarolli

[57] ABSTRACT

A modular steam bath cabinet has a steam generating system including a heated, inclined evaporating surface over which heated liquid flows to cause evaporation of the liquid. Any known evaporated liquid is collected, reheated and recirculated. Heated liquid may also be circulated to a shower nozzle. The steam generating system is part of the module, which includes the floor of the cabinet.

18 Claims, 4 Drawing Figures

STEAM BATH APPARATUS AND LIQUID OR STEAM TREATMENT EQUIPMENT

The invention relates to a steam bath apparatus. The invention also relates to liquid and/or steam treatment equipment.

Known steam bath apparatuses of the type mentioned above require, if they are to produce an almost saturated steam atmosphere in the cabin, relatively large quantities of liquid and a considerable amount of heat energy to heat the said liquid. It is therefore the purpose of the invention to provide a steam bath apparatus which needs less water and heat energy and which occupies a relatively small amount of space.

A steam bath apparatus of this kind requires, in principle, only a small amount of liquid to produce a layer of liquid which flows over the surface of the evaporator. This also reduces the amount of power or energy required for heating and generating steam. At the same time it assures reliable formation of high, almost saturated atmospheric humidity in the cabin, as a result of continuous contact with a layer of liquid which has a large area.

This development leads to substantial savings in liquid or water since only losses due to steam escaping from the cabin need be replaced by fresh liquid or water. The savings in energy achieved by this development is also particularly great, since the heat content of the condensate or return is re-used at the inlet to produce steam. According to another development, it is possible to provide intensive treatment of the human body with active substances with a steam bath apparatus, with extremely little additional structural expense. Furthermore, and especially in conjunction with the above-mentioned characteristics of the invention relating to circulation, this circulation provides a substantial saving of the said active substances.

Finally, still further space is saved by the use of a modular system for a sauna-cabin of the type mentioned above. These characteristics reduce shipping volume and make it easily possible for the user to assemble the apparatus himself.

Further characteristics and advantages of the invention are explained hereinafter, in conjunction with the examples of embodiment illustrated in the drawings attached hereto, wherein.

Figure 1:
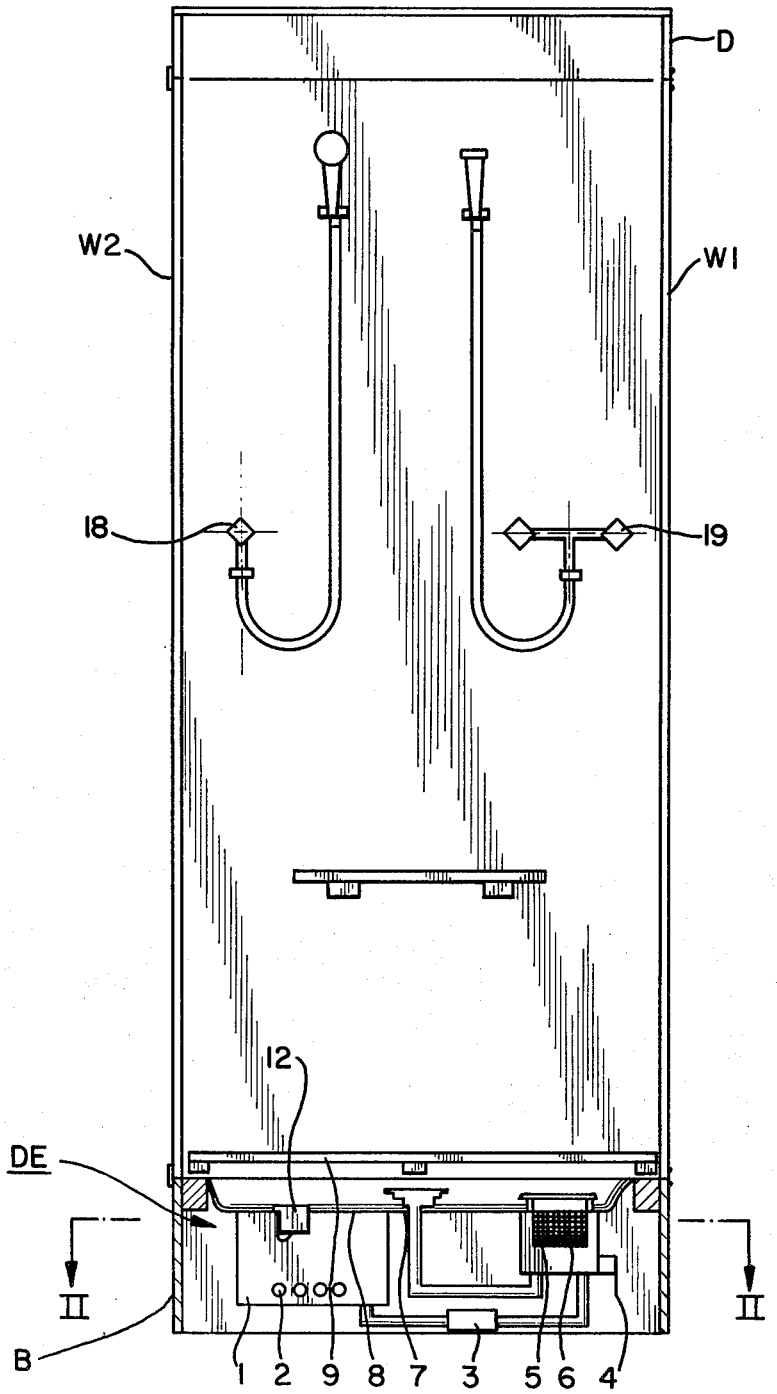
FIG. 1 is a diagrammatical vertical section along the centerline of a steam bath apparatus according to the invention.
Figure 2:
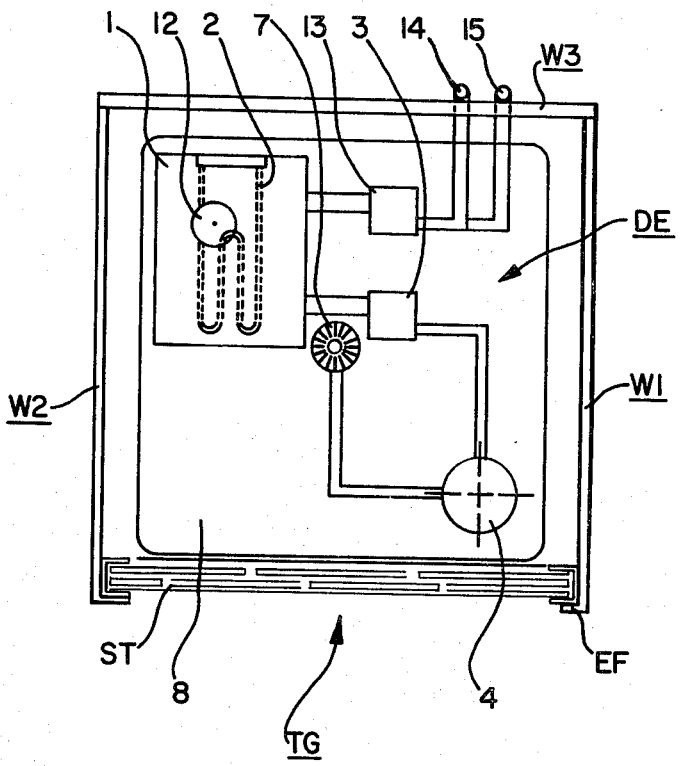
FIG. 2 is an also diagrammatic horizontal section of the steam bath apparatus, in the plane II—II in FIG. 2.

The steam bath apparatus comprises a cabin in the form of a modular system of structural units detachably connected to each other, to wit side and rear wall assemblies Wl to W3, a door assembly TG, a ceiling assembly D and a floor assembly B containing the steam-generating unit.

The steam-generating unit comprises a floor or sauna trough 8 with a grating 9 arranged at a distance thereabove. The floor surface of trough 8 constitutes an evaporating surface acted upon directly by the liquid used to generate the steam which is supplied by an arrangement of nozzles 7. Located on a level with the floor surface of trough 8 is a drain 12. A thin, flowing layer of heated liquid, supplied by nozzle arrangement 7, is thus formed upon the evaporating surface. Only a small volume of liquid is therefore needed to produce an almost saturated steam atmosphere.

The steam-generating unit also comprises a liquid circulation consisting of a collecting vessel 1, into which drain 12 opens, followed by a circulating pump 3 and the above-mentioned nozzle arrangement 7 which supplies liquid to the evaporating surface.

Also accomodated under trough 8, like the remaining elements of the steam-generating unit, in order to save space, is a heater unit 2 located in the liquid circulation. The arrangement of this unit within collecting vessel 1 assists in the effective transfer of heat.

Also located in the circulation of liquid is an active substance solution or mixing container 4 having a filter insert 5 and a cap 6, hereinafter abbreviated to "herb-container". As shown in FIG. 1, this container is arranged within trough 8, thus contributing to a compact configuration of the steam-generating unit as a whole.

Also arranged within the cabin is a shower unit comprising two different instruments with relevant fittings 18, 19. By means of lines and suitable valving, the said shower unit is connected to the liquid circulation of the steam-generating unit, i.e., to circulating pump 3, and thus to the heater unit used to heat the shower water. This connection into the circulation also permits the shower water to be enriched with active substances.

One particular advantage of the steam bath apparatus according to the invention is ease of conversion from one of its various functions to another, namely the basic function of treating the human body with an atmosphere of saturated steam, an extended treatment in which the liquid and the steam generated therefrom is enriched with active substances, more particularly essentially oils, producing the effect of complete immersion in a herbal bath, and the function of a shower, if necessary with the massaging action of powerful jets. For the purpose of producing increased pressure, the shower unit is also provided with its own pressure pump 13 which may be switched on at will and may be selectively connected to an external water supply.

These functions are explained hereinafter, in conjunction with the characteristics of the apparatus, in the following examples of embodiment.

Shower

When the apparatus is used as a shower stall, cold and hot water flows through the inlet valve to mixer faucets 19 to which the shower head is connected. Pump 13, which is switched on automatically when "shower" is selected at control box 21, pumps the waste water out continuously through outlet hose 14.

Steam Sauna

Water container 1, with electric heater 2, is filled through the inlet valve and is controlled by the level regulator and the required temperature and time are set at control box 21. Circulating pump 3 pumps hot water through distributor nozzle 7, into sauna trough 8 and distributes it uniformly over the evaporating surface, thus ensuring uniform generation of steam. The return is through outlet aperture 12, from sauna trough 8, into water container 1.

During the entire treatment, the hot water circuit is supplied by the water with which the system is originally filled, only water lost by evaporation being topped up under control of the level regulator. As soon as the treatment has been completed, the system is emptied by pump 13 through hose 14.

Steam Sauna With Medicinal Herbs

The procedure is the same as for the "steam sauna", except that threaded cap 6 is removed and the medicinal herbs desired are introduced into filter screen 5. Intensive flushing makes sure that good use is made of the herbs. The said filter prevents any fragments of herbs from entering the circuit. It may easily be removed for cleaning at the conclusion of the treatment. The system is emptied by pump 13 through hose 14.

Massage in Medicinal Herb Bath

The procedure is as for the "steam sauna with medicinal herbs", except that a lower temperature is selected at control box 21. Pressure pump 13 is also switched over to "massage" and massage head (18) (obtainable commercially) is set in operation. Water pressure from pump 13 may be used to cause the brush on the massage head to provide a rotating-vibrating action or to produce a jet of water. The advantages obtained from the invention are to be perceived mainly in that it is possible to obtain, with 10% of the means used, the effect of a full immersion medicinal herb bath, with a constant supply of liquid, room temperature and the possibility of massage treatment.

If it is desired, or necessary from the point of view of health, the effect of an alternating bath can be obtained during all of the foregoing operations by using cold water from mixer faucet 19.

A folding seat is provided on the inner surface of the rear wall. When not in use, the seat folds up automatically.

Figure 3:
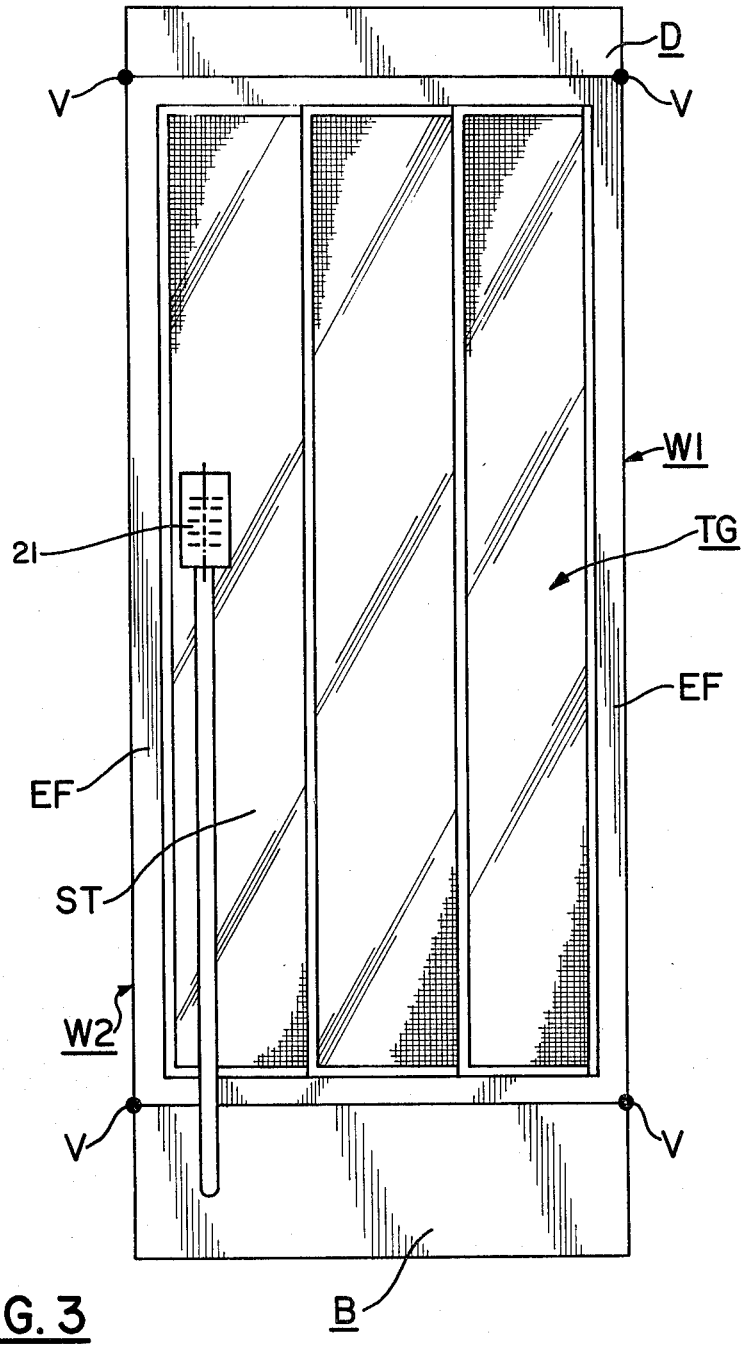
FIG. 3 is an overall front elevation of the steam bath cabin.

As indicated in FIG. 3, the cabin for this steam bath apparatus consists of structural elements connected detachably to each other, to which end known connecting elements V—indicated diagrammatically—are provided. They may be in the form of catches, bayonet-fasteners, or simply bolted joints. Access to the cabin is through a multi-panel sliding door ST which is easy to operate and provides adequate sealing against the escape of steam and liquid. This sliding door is held in a frame or wall-like mounting EF, thus producing a door unit TG which is also secured within the cabin structure by means of detachable connecting elements.

Figure 4:
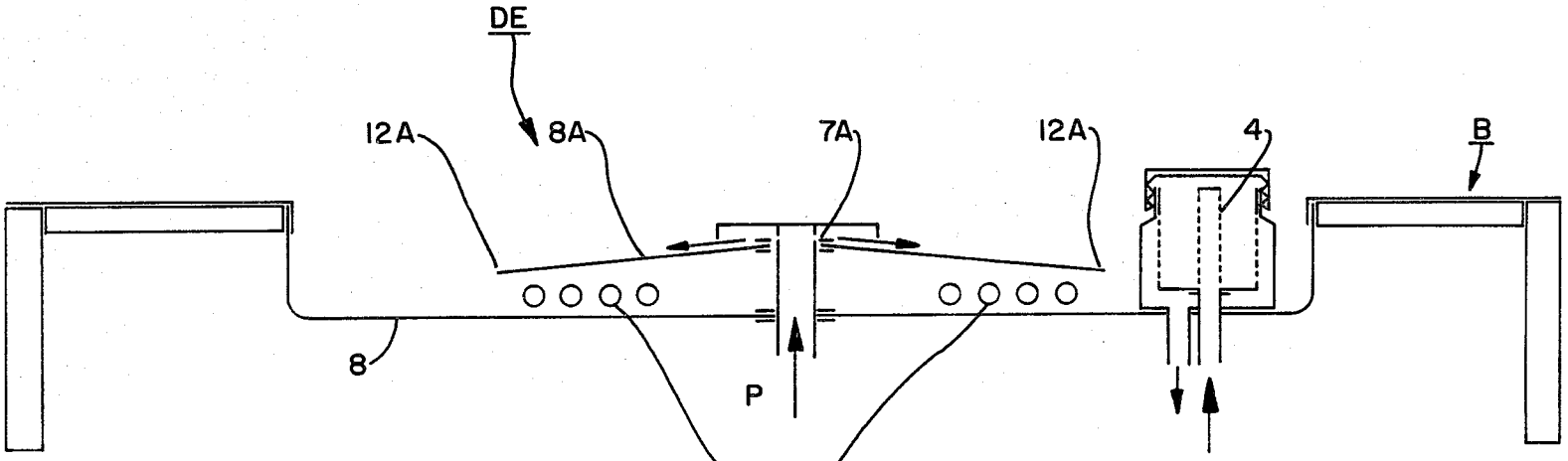
FIG. 4 is a diagrammatical vertical section through a modified design of the base unit of a steam bath apparatus according to the invention.

The design of a cabin floor group B with a steam-generating unit DE, according to FIG. 4, is characterized in that an evaporating surface 8A slopes slightly or is in the form of a truncated cone with very obtuse angles. In this case the fluid is supplied directly to the evaporating surface by an arrangement of nozzles 7A located centrally of the conical surface. The thin film of liquid to be evaporated flows from the center to circular edge 12A of the evaporating surface. In conjunction with the rotational symmetrical inclination of the surface, this results in a particularly uniform flow and evaporation of the thin film of liquid. The outer edge of the evaporating surface is arranged above the bottom of a trough 8 and thus acts as a drain for the evaporator. As compared with the use of separate collecting vessels for the liquid, this considerably simplifies the design of the unit.

Also according to the example illustrated in FIG. 4, evaporating surface 8A is within the radiation and/or heat conducting range of a heater unit 2A. In this way, the liquid to be evaporated may be heated, in whole or in part, directly as it flows over the said evaporating surface. This produces a very efficient and compact unit, as a result of the large quantity of liquid evaporated as compared with the size of the evaporating surface. The advantage of this arrangement is that heater unit 2A, located under evaporating surface 8A, heats up not only the return liquid collecting in trough 8, but also the liquid supplied, in the direction of arrow P, to nozzle arrangement 7A and flowing over the said evaporating surface. Thus large heat transfer surfaces and comparatively long heating periods are available for the purpose of heating the liquid, all of which leads to satisfactory thermal efficiency.

I claim:

1. A steam bath apparatus comprising a cabinet with an access opening adapted to be closed by door means; a steam generating system located in said cabinet and including an evaporation surface, heating means for heating said evaporation surface and for heating liquid to be evaporated, a liquid outlet for supplying liquid to be evaporated onto said evaporation surface, collecting means for collecting any non-evaporated liquid from said evaporation surface, and pumping means having an inlet and an outlet for recirculating said non-evaporated liquid to said liquid outlet; said collecting means comprising a tub having a floor and disposed at the bottom of said cabinet and covered by a grating, said evaporation surface comprising at least a part of said floor of said tub, said liquid outlet comprising nozzle means located above said floor of said tub and below said grating for dispensing a heated layer of liquid flowing over said evaporation surface for generating steam within said cabinet.

2. A steam bath apparatus according to claim 1, wherein said evaporation surface comprises a drain surface sloping towards an outlet opening in said floor of said tub.

3. A steam bath apparatus according to claim 2, wherein said floor of said tub comprises a slightly inclined truncated conical surface, said nozzle means being centrally located above said conical surface and said outlet opening being located at the periphery of said conical surface.

4. A steam bath apparatus according to claim 1, wherein said heating means comprises an electrical heater unit located below said evaporation surface.

5. A steam bath apparatus according to one of claims 1 or 4, wherein said steam generating system further comprises a liquid collector chamber located below said tub in the floor of said cabinet, said liquid collector chamber being connected to said inlet of said pumping means, said pumping means being located below said tub.

6. A steam bath apparatus according to claim 5, wherein said heating means comprises heated surface means located within said liquid collector chamber.

7. A steam bath apparatus according to claim 6, further comprising a liquid circuit having at least one shower unit connected to said liquid collector chamber and said outlet of said pumping means.

8. A steam bath apparatus according to claim 7, wherein said pumping means is adapted to selectively produce different liquid outlet pressures.

9. A steam bath apparatus according to claim 8, wherein said liquid circuit comprises at least one liquid heating unit adapted to be operated at different heating temperatures.

10. A steam bath apparatus according to claim 7, wherein said liquid circuit comprises at least one liquid heating unit adapted to be operated at different heating temperatures.

11. A steam bath apparatus according to claim 7, wherein at least one solution chamber for receiving an active substance is provided in said liquid circuit.

12. A steam bath apparatus according to claim 7, wherein said cabinet comprises a modular system having detachably connected structural components comprising a plurality of wall units, a ceiling unit and a floor and tub unit.

13. A steam bath apparatus according to claim 12, wherein said structural components include a first wall unit having at least one sliding door means.

14. A steam bath apparatus according to claim 13, wherein said first wall unit is adapted to be connected detachably to adjacent cabinet components.

15. A steam bath apparatus according to claim 1, wherein said steam generating system further comprises at least one solution chamber for receiving an active substance, said liquid to be evaporated being circulated through said solution chamber.

16. A steam bath apparatus according to claim 15, wherein said solution chamber comprises a detachable cap and a filter insert for the accommodation of active substances in solid form such as herbs.

17. A steam bath apparatus according to claim 16, wherein said solution chamber is located within said tub.

18. A steam bath apparatus according to one of claims 2 or 17, wherein said cabinet comprises a modular system having detachably connected structural components comprising a plurality of wall units, a ceiling unit and a floor and tub unit.

* * * * *